US009890572B2

(12) United States Patent
Tarr et al.

(10) Patent No.: US 9,890,572 B2
(45) Date of Patent: Feb. 13, 2018

(54) LATCH ASSEMBLY

(71) Applicants: General Electric Company, Schenectady, NY (US); emz-Hanauer GmbH & Co. KGaA, Nabburg (DE)

(72) Inventors: Ronald Scott Tarr, Louisville, KY (US); Srinivas Mallampalli, Bangalore (IN); Anthony Durfee, Granger, IN (US); Peter Nitsche, Beilingries (DE)

(73) Assignee: Haier US Appliance Solutions, Inc., Wilmington, DE (US)

( * ) Notice: Subject to any disclaimer, the term of this patent is extended or adjusted under 35 U.S.C. 154(b) by 490 days.

(21) Appl. No.: 14/532,263

(22) Filed: Nov. 4, 2014

(65) Prior Publication Data

US 2016/0123052 A1 May 5, 2016

(51) Int. Cl.

| | |
|---|---|
| ***E05C 19/16*** | (2006.01) |
| ***E05B 47/00*** | (2006.01) |
| ***E05B 15/02*** | (2006.01) |
| ***E05F 7/00*** | (2006.01) |
| ***A47L 15/42*** | (2006.01) |

(52) U.S. Cl.

CPC ..... *E05C 19/16* (2013.01); *A47L 15/4259* (2013.01); *E05B 15/022* (2013.01); *E05B 15/024* (2013.01); *E05B 47/0038* (2013.01); *E05B 47/0046* (2013.01); *E05F 7/005* (2013.01); *Y10S 292/55* (2013.01); *Y10S 292/60* (2013.01); *Y10S 292/69* (2013.01); *Y10T 292/11* (2015.04); *Y10T 292/702* (2015.04)

(58) Field of Classification Search

CPC ..... E05C 19/16; E05C 19/163; E05C 19/166; E05C 19/168; E05C 19/161; E05C 17/56; E05B 15/022; E05B 15/024; E05B 15/0073; E05B 47/00; E05B 47/0038; E05B 47/004; E05B 47/0046; E05B 47/0047; E05F 7/005; A47L 15/4259; Y10S 292/55; Y10S 292/60; Y10S 292/69; Y10S 292/39; Y10S 292/51; Y10T 292/11; Y10T 292/696; Y10T 292/707; Y10T 292/702; Y10T 292/705; Y10T 292/0863; Y10T 292/0877; Y10T 292/0886; Y10T 292/0887; Y10T 292/691

USPC ..... 292/251.5, DIG. 55, DIG. 60, DIG. 69, 292/DIG. 39, DIG. 51, 341.15, 341.17, 292/341.18, 341.19, 57, 71, 63, 64, 292/341.13

See application file for complete search history.

(56) References Cited

U.S. PATENT DOCUMENTS 2,508,305 A * 5/1950 Teetor ..... E05C 19/16 206/818
2,586,900 A * 2/1952 Alderman ..... E05C 19/163 292/153

(Continued)

FOREIGN PATENT DOCUMENTS

GB 1138231 A * 12/1968 ..... E05C 17/56
JP 03002482 A * 1/1991
WO WO 2013076140 A2 * 5/2013 ..... H02J 5/005

*Primary Examiner* — Christine M Mills
(74) *Attorney, Agent, or Firm* — Dority & Manning, P.A.

(57) ABSTRACT

A latch assembly includes coplanar pairs of magnets that engage each other when the latch assembly is in a closed position in order to secure the latch assembly in the closed position. A related appliance with features for selectively securing a door of the appliance in a closed position is also provided.

16 Claims, 11 Drawing Sheets

(56) References Cited

U.S. PATENT DOCUMENTS

| | | | | | |
|---|---|---|---|---|---|
| 2,792,249 | A * | 5/1957 | Saxton | E05C 19/16 | 292/251.5 |
| 2,950,139 | A * | 8/1960 | Carbary | E05C 19/163 | 109/63.5 |
| 2,990,210 | A * | 6/1961 | Fremstad | E05C 19/16 | 292/251.5 |
| 3,004,309 | A * | 10/1961 | Korodi | E05C 19/161 | 312/296 |
| 3,261,631 | A * | 7/1966 | Alessi | E05C 17/56 | 292/251.5 |
| 3,790,197 | A * | 2/1974 | Parker | E05C 19/16 | 292/251.5 |
| 3,913,958 | A * | 10/1975 | Larime | E05C 17/56 | 292/251.5 |
| 7,654,590 | B2 * | 2/2010 | Hapke | A47L 15/4259 | 134/57 DL |
| 8,861,199 | B2 * | 10/2014 | Liang | G06F 1/1616 | 292/251.5 |
| 2010/0283270 | A1 * | 11/2010 | Hood, III | E05B 17/0033 | 292/251.5 |

* cited by examiner

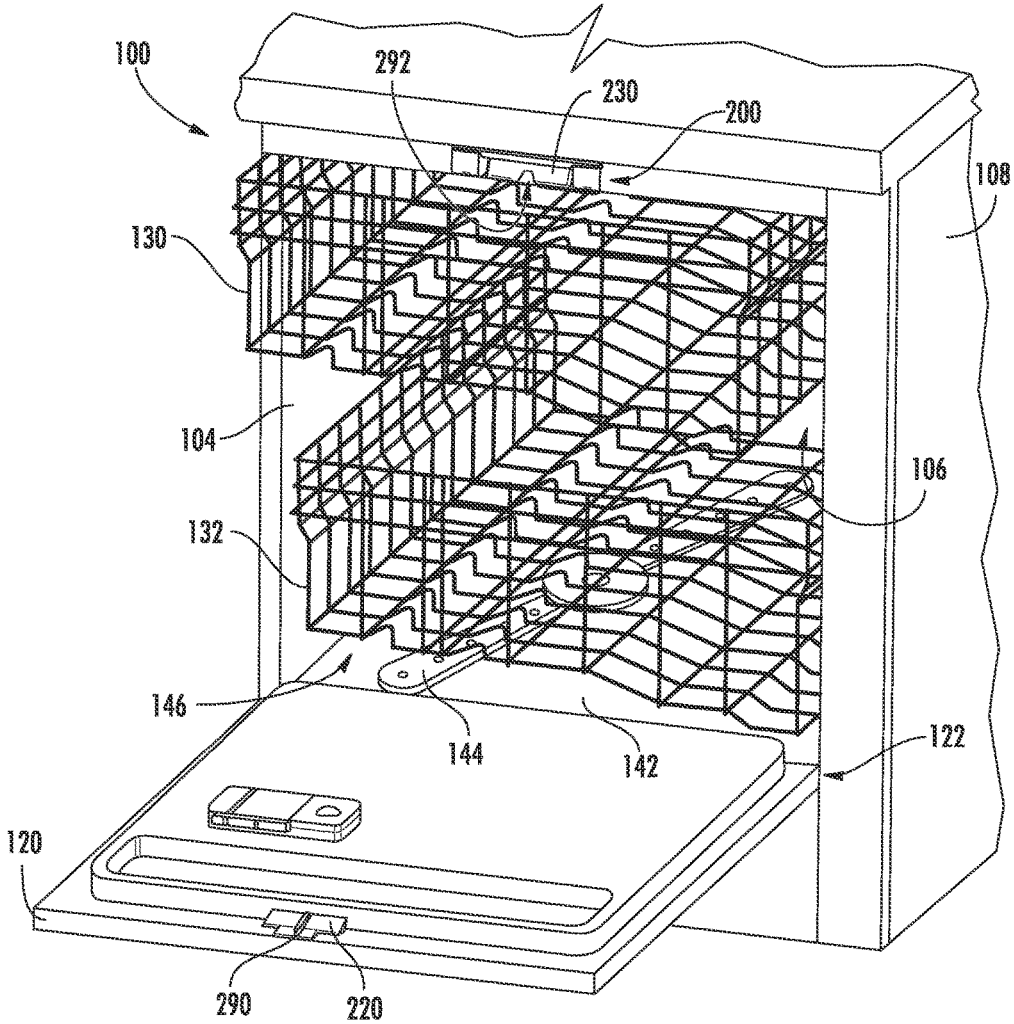
FIG. 2
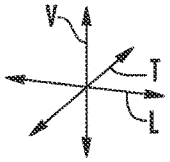

LATCH ASSEMBLY

FIELD OF THE INVENTION

The present subject matter relates generally to latch assemblies, such as latch assemblies suitable for use in appliances.

BACKGROUND OF THE INVENTION

Certain appliances include mechanical latch assemblies for holding doors of the appliances in a closed position. Such mechanical latch assemblies are generally burst type latch assemblies where a user pulls on the door until a holding force is overcome and the door opens. Similarly, the user pushes on the door to overcome a resistance force of the burst type latch assembly and close the door. Overcoming the holding force of the burst type latch assembly to open the door can be difficult and inconvenient. Likewise, overcoming the resistance force of the burst type latch assembly to close the door can be difficult and inconvenient. In particular, the door may not properly close if the user fails to fully overcome the resistance force of the burst type latch assembly.

Magnetic latch assemblies are also available to hold doors closed. Such magnetic latch assemblies generally include a magnet that draws a door shut without a user applying any force to the door. However, opening the door can be difficult because an initial opening force of the magnetic latch assembly can be quite high due to the force versus displacement characteristics of the magnet.

In addition, doors are generally designed to be centered on a cabinet when the door is closed. However, normal manufacturing variation often results in the door being slightly off center when the door is in the closed position. For example, the door may be two or three millimeters to the left or right of center when the door is in the closed position. Handling such variation is a challenge for both burst latches and magnetic latches.

Accordingly, a magnetic latch assembly that draws a door closed while also being easy to open would be useful. In addition, a magnetic latch assembly with features for assisting with holding the door in a closed position despite the door being off center in the closed position would be useful.

BRIEF DESCRIPTION OF THE INVENTION

The present subject provides a latch assembly. The latch assembly includes coplanar pairs of magnets that engage each other when the latch assembly is in a closed position in order to secure the latch assembly in the closed position. A related appliance that includes features for selectively securing a door of the appliance in a closed position is also provided. Additional aspects and advantages of the invention will be set forth in part in the following description, or may be apparent from the description, or may be learned through practice of the invention.

In a first exemplary embodiment, a latch assembly is provided. The latch assembly includes a stator having a first end portion and a second end portion. A first magnet is positioned at the first end portion of the stator. The first magnet has an outer surface. A second magnet is positioned at the second end portion of the stator. The second magnet has an outer surface. The outer surface of the second magnet is positioned coplanar with the outer surface of the first magnet. A mover has a first end portion and a second end portion. A third magnet is positioned at the first end portion of the mover. The third magnet has an outer surface. The outer surface of the third magnet is positioned adjacent the outer surface of the first magnet when the latch assembly is in a closed position. A fourth magnet is positioned at the second end portion of the mover. The fourth magnet has an outer surface. The outer surface of the fourth magnet is positioned adjacent the outer surface of the second magnet when the latch assembly is in the closed position. The outer surface of the fourth magnet is positioned coplanar with the outer surface of the third magnet.

In a second exemplary embodiment, an appliance is provided. The appliance includes a cabinet. A door is pivotally mounted to the cabinet. A latch assembly is configured for selectively securing the door in a closed configuration. The latch assembly includes a stator having a first end portion and a second end portion. The stator is positioned on the cabinet. A first magnet is positioned at the first end portion of the stator. The first magnet has an outer surface. A second magnet is positioned at the second end portion of the stator. The second magnet has an outer surface. The outer surface of the second magnet is positioned parallel to the outer surface of the first magnet. A mover has a first end portion and a second end portion. The mover is positioned on the door. A third magnet is positioned at the first end portion of the mover. The third magnet has an outer surface. The outer surface of the third magnet is positioned at the outer surface of the first magnet when the door is in the closed configuration. A fourth magnet is positioned at the second end portion of the mover. The fourth magnet has an outer surface. The outer surface of the fourth magnet is positioned at the outer surface of the second magnet when the door is in the closed configuration. The outer surface of the fourth magnet is positioned parallel to the outer surface of the third magnet.

In a third exemplary embodiment, an appliance is provided. The appliance includes a cabinet. A door is pivotally mounted to the cabinet. The latch assembly also includes means for selectively securing the door in a closed configuration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 2 provides a partial perspective view of the exemplary dishwasher appliance of FIG. 1 positioned within a cabinet.

DETAILED DESCRIPTION

Figure 1:
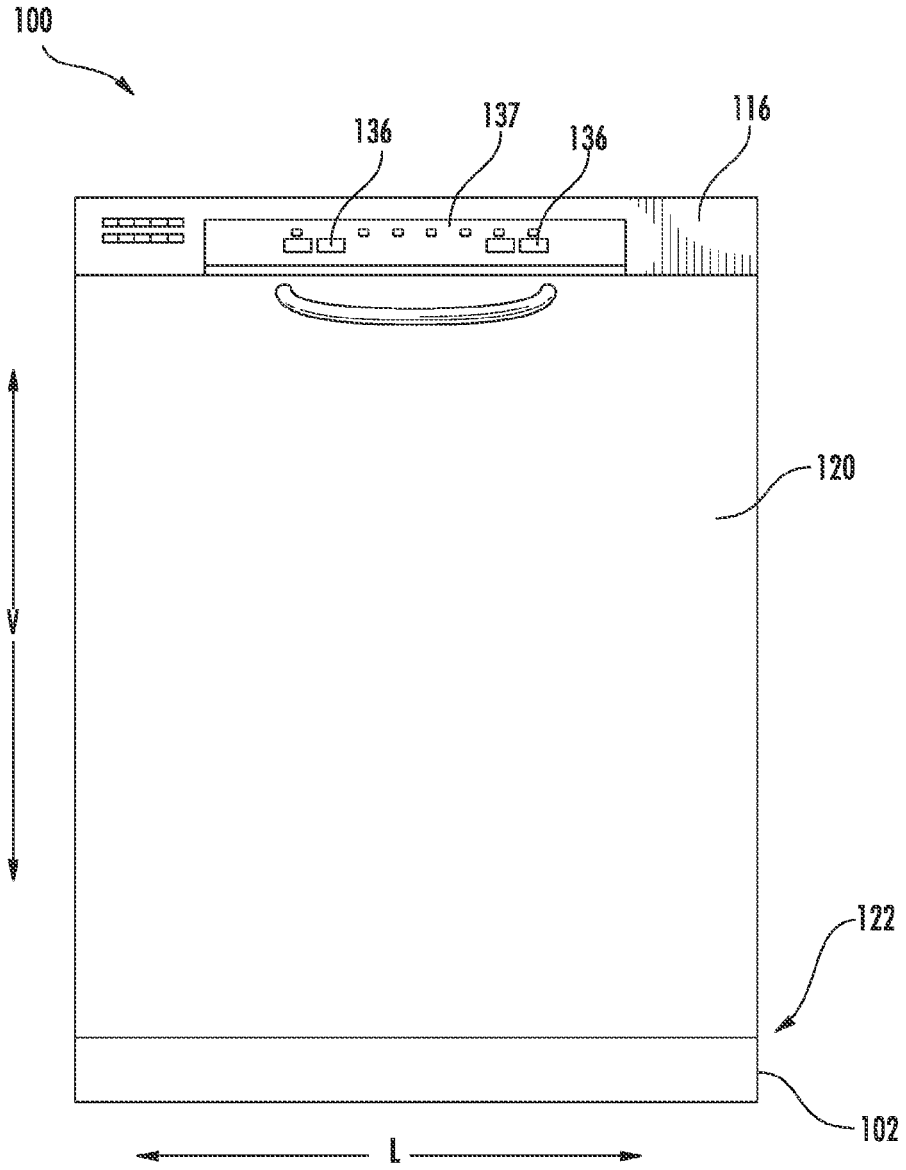
FIG. 1 provides a front, elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a dishwasher appliance 100 according to an exemplary embodiment of the present subject matter. FIG. 2 provides a partial perspective view of dishwasher appliance 100 positioned within a cabinet 108. Dishwasher appliance 100 includes a tub 104 that defines wash compartment 106. Tub 104 includes door 120 hinged at its bottom 122 for movement between a normally closed configuration (shown in FIG. 1) in which wash compartment 106 is sealed shut, e.g., for washing operation, and an open configuration (shown in FIGS. 2, 3 and 4) for loading and unloading of articles from dishwasher appliance 100.

Dishwasher appliance 100 includes middle and lower rack assemblies 130, 132. Each of the middle and lower racks assemblies 130, 132 is fabricated from lattice structures that include a plurality of wires or elongated members. Each rack assembly 130, 132 is adapted for movement between an extended loading position (not shown) in which the rack assembly is substantially positioned outside the wash compartment 106, and a retracted position (shown in FIGS. 1 and 2) in which the rack assembly is located inside the wash compartment 106.

Dishwasher appliance 100 includes a lower spray assembly 144 that is mounted within a lower region 146 of the wash compartment 106 and above a tub sump portion 142 so as to be in relatively close proximity to the lower rack assembly 132. A mid-level spray assembly (not shown) may also be located in an upper region of the wash compartment 106 and may be located in close proximity to middle rack assembly 130. The lower spray assembly 144 is fed by a pump (not shown) for circulating water and wash fluid (e.g., detergent, water, and/or rinse aid) in the tub 104. The pump may be located in a machinery compartment below the bottom sump portion 142 of the tub 104, as generally recognized in the art. Each spray assembly includes an arrangement of discharge ports or orifices for directing wash fluid onto dishes or other articles located in the middle and lower rack assemblies 130, 132. Lower spray assembly 144 is rotatably mounted in wash compartment 106. Accordingly, the arrangement of the discharge ports on lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated exemplary embodiment, controller 137 is located within a control panel 116 of door 120. In alternative exemplary embodiments, controller 116 may be positioned beneath tub 104 or at any other suitable location on dishwasher appliance 100. Typically, controller 137 includes a user interface panel 136 through which a user may select various operational features and modes and monitor progress of the dishwasher appliance 100. In one exemplary embodiment, user interface 136 represents a general purpose I/O ("GPIO") device or functional block. In another exemplary embodiment, user interface 136 includes input components, such as one or more of a variety of electrical, mechanical or electro-mechanical input devices including rotary dials, push buttons, and touch pads. User interface 136 may include a display component, such as a digital or analog display device designed to provide operational feedback to a user.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations or spray assembly arrangements.

Figure 3:
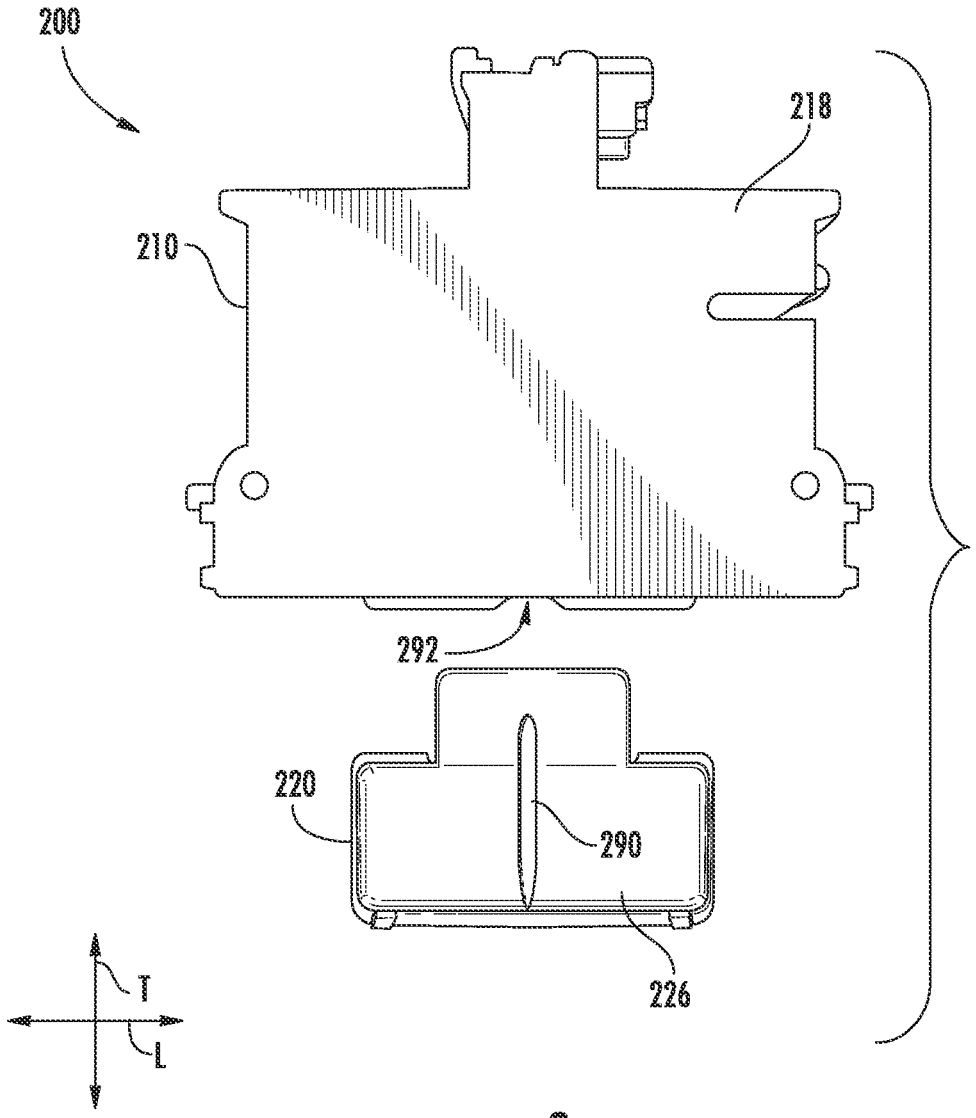
FIG. 3 provides a top, plan view of a latch assembly according to an exemplary embodiment of the present subject matter.

FIG. 3 provides a top, plan view of a latch assembly 200 according to an exemplary embodiment of the present subject matter. Latch assembly 200 can be used for any suitable purpose. As an example, latch assembly 200 may be used on an appliance, such as dishwasher appliance 100 (FIG. 1). As another example, latch assembly 200 may be used on a microwave appliance, a washer appliance, a dryer appliance, a trash compactor, an oven appliance, etc. As will be understood by those skilled in the art, latch assembly 200 may be used to selectively secure a door of such appliances in a closed position. As an example, a moving portion 220 may be mounted to a door of such appliances, and a static portion 210 of latch assembly 200 may be mounted to a cabinet of such appliances. Thus, as shown in FIG. 2, moving portion 220 may be mounted to door 120 of dishwasher appliance 100, and static portion 210 may be mounted to tub 104 of dishwasher appliance 100. As another example, moving portion 220 of latch assembly 200 may be mounted to the cabinet of such appliances, and static portion 210 may be mounted to the door of such appliances.

Latch assembly 200 defines a lateral direction L and a transverse direction T. The lateral direction L and the transverse direction T are perpendicular to each other. The lateral direction L and the transverse direction T may also both be perpendicular to a vertical direction V, e.g., to form an orthogonal direction system. Latch assembly 200 may operate or function in a similar manner to the latch assembly described in U.S. patent Ser. No. 14/053,675 of Ronald Scott Tan et al. entitled "A Latch Assembly" filed on Oct. 15, 2013, which is incorporated herein by reference in its entirety.

Figure 4:
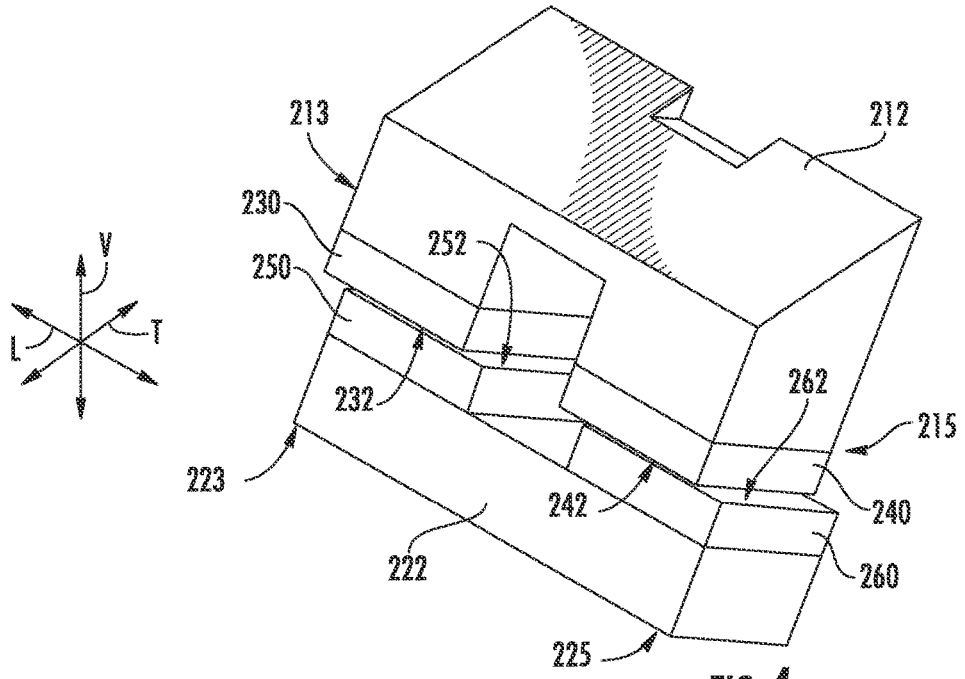
FIGS. 4, 6 and 8 provide perspective views of a stator and a mover of the exemplary latch assembly of FIG. 3 shown in various positions.
Figure 5:
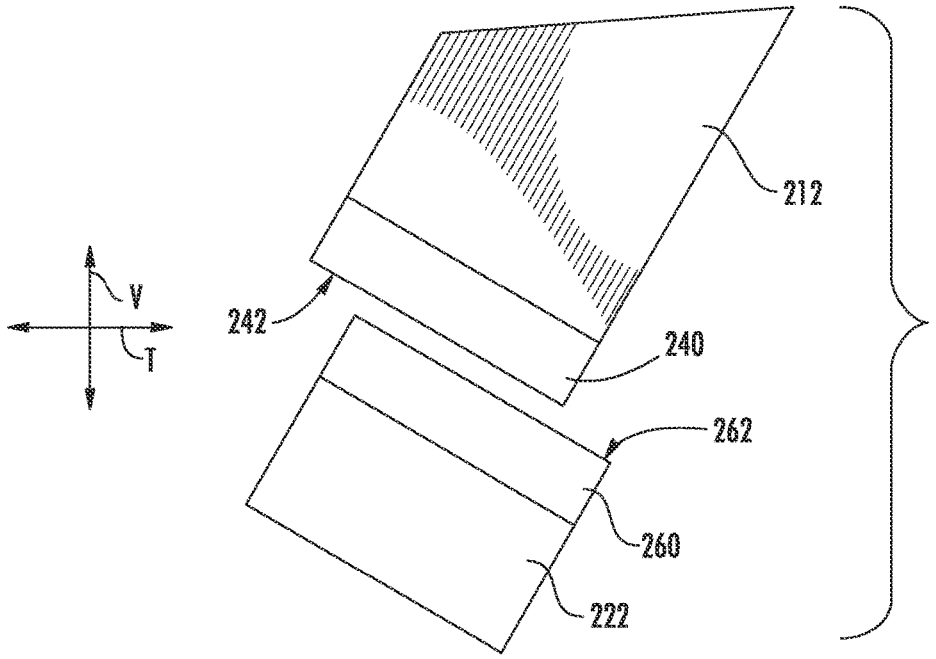
FIGS. 5, 7 and 9 provide side, elevation views of a stator and a mover of the exemplary latch assembly of FIG. 3 shown in various positions.
Figure 6:
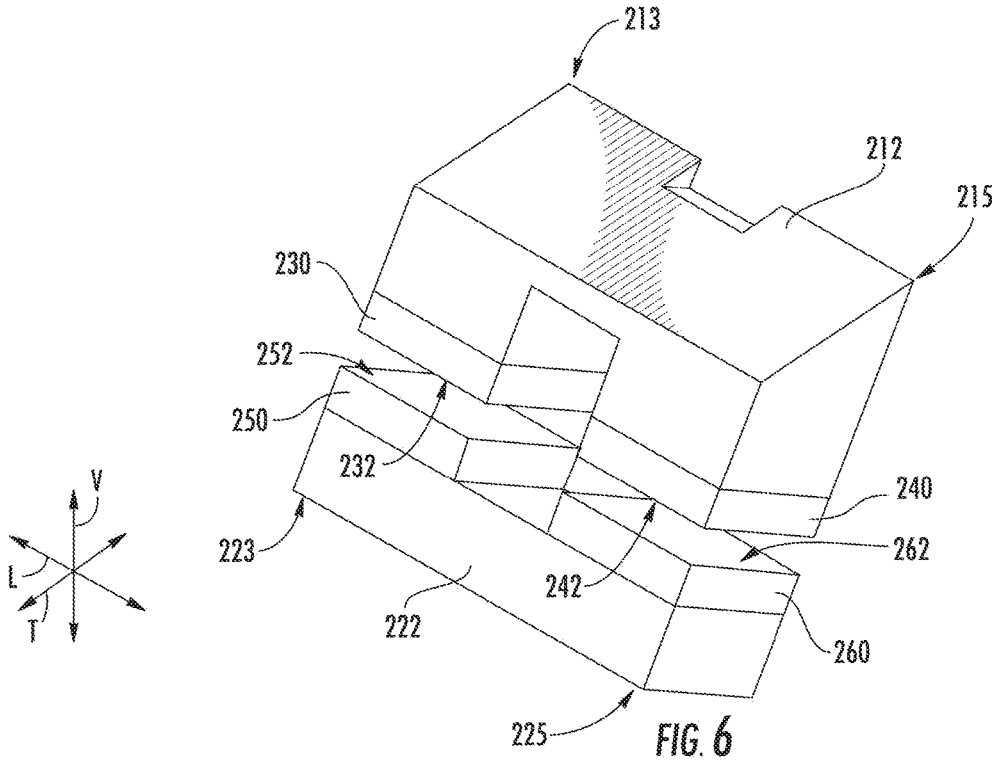
Figure 7:
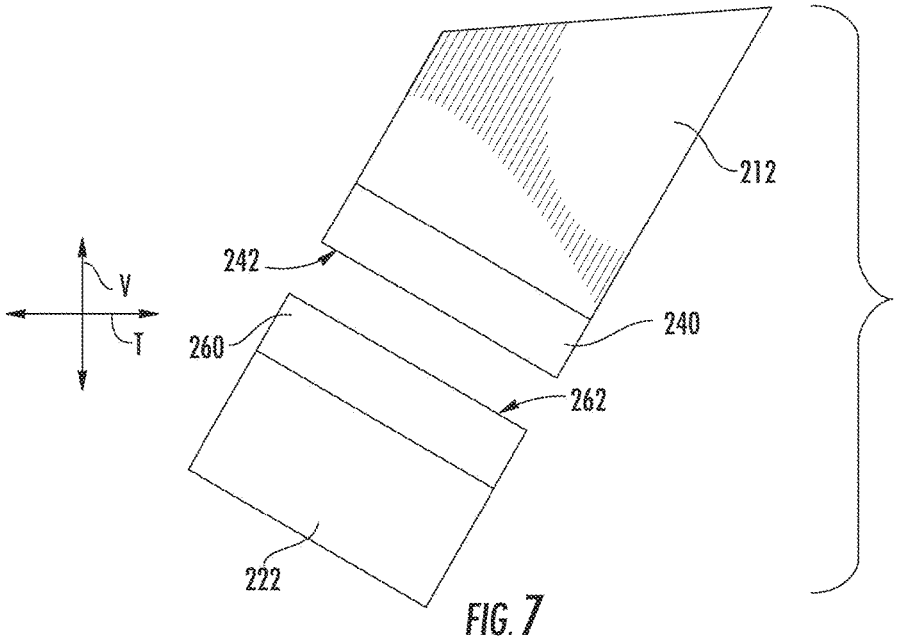
Figure 8:
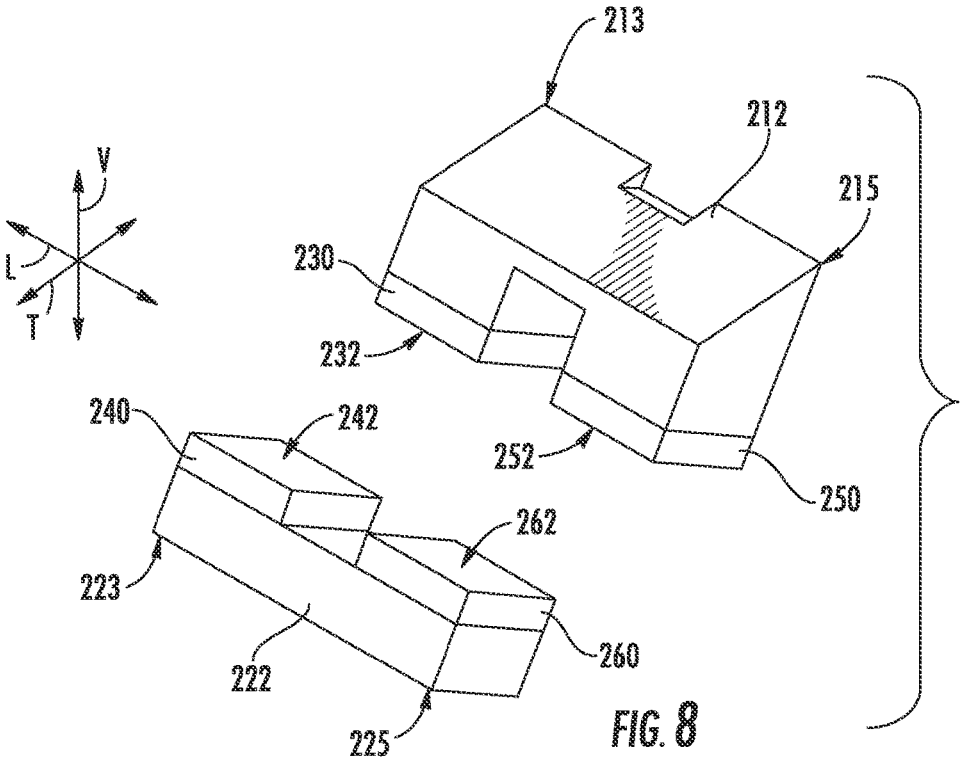
Figure 9:
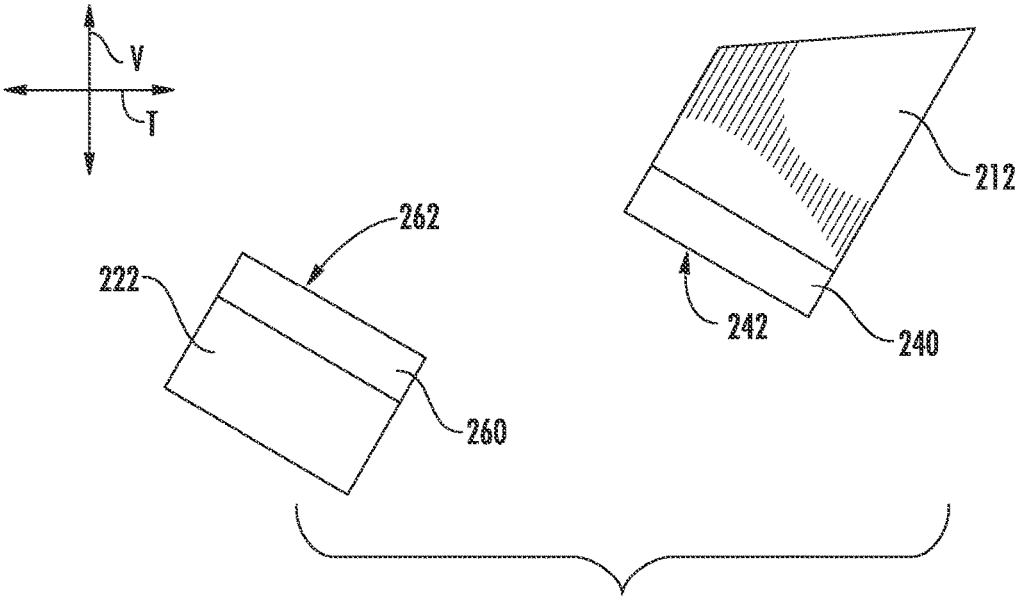

FIGS. 4, 6 and 8 provide perspective views of certain components of latch assembly 200. FIGS. 5, 7 and 9 provide side, elevation views of certain components of latch assembly 200. In FIGS. 4, 5, 6, 7, 8 and 9, a mover 222 of latch assembly 200 is shown in various positions relative to a back iron or stator 212 of latch assembly 200. In FIGS. 4 and 5, latch assembly 200 is shown in a closed position. Conversely, latch assembly 200 is shown in an open position in FIGS. 8 and 9. Latch assembly 200 is shown in a position between the open and closed positions in FIGS. 6 and 7. A user can selectively adjust latch assembly 200 between the open and closed positions.

As may be seen in FIGS. 4, 6 and 8, latch assembly 200 includes stator 212, mover 222, a first magnet 230, a second magnet 240, a third magnet 250 and a fourth magnet 260. First and second magnets 230, 240 are mounted to stator 212. Conversely, third and fourth magnets 250, 260 are mounted to mover 222. As discussed in greater detail below, first and second magnets 230, 240 engage the third and fourth magnets 250, 260 to hold latch assembly 200 in the closed position (shown in FIGS. 4 and 5). The position and orientation of first, second, third and fourth magnets 230, 240, 250, 260 assist with shaping the force required to shift latch assembly 200 from the closed position to the open position (shown in FIGS. 8 and 9). Such features of latch assembly 200 are discussed in greater detail below.

As may be seen in FIGS. 4, 6 and 8, stator 212 extends between a first end portion 213 and a second end portion 215, e.g., along the lateral direction L. Thus, first and second end portions 213, 215 of stator 212 are spaced apart from each other, e.g., along the lateral direction L. First magnet 230 is mounted to stator 212 at first end portion 213 of stator 212, and second magnet 240 is mounted to stator 212 at second end portion 215 of stator 212. Thus, first and second magnets 230, 240 are spaced apart from each other, e.g., along the lateral direction L.

Stator 212 can be constructed of any suitable material. In certain exemplary embodiments, stator 212 is constructed of a material having a relatively high conductivity. As an example, stator 212 may be constructed of a metal, such as steel.

As discussed above, first magnet 230 is positioned at first end portion 213 of stator 212. First magnet 230 has an outer surface 232. Second magnet 240 is positioned at second end portion 215 of stator 212. Second magnet 240 also has an outer surface 242. Outer surface 232 of first magnet 230 and outer surface 242 of second magnet 240 may be positioned coplanar and/or parallel with each other.

Poles of first and second magnets 230, 240 may be oriented to assist with shaping the holding force of latch assembly 200. For example, a southern pole of first magnet 230 may be positioned at or adjacent outer surface 232 of first magnet 230, and a northern pole of first magnet 230 may be positioned at an opposite side of first magnet 230, e.g., adjacent or at first end portion 213 of stator 212. Conversely, a northern pole of second magnet 240 may be positioned at or adjacent outer surface 242 of second magnet 240, and a southern pole of second magnet 240 may be positioned at an opposite side of second magnet 240, e.g., adjacent or at second end portion 215 of stator 212. Such alignment can assist with coupling first and second magnets 230, 240 when latch assembly 200 is closed as will be understood by those skilled in the art. It should be understood that the orientation of the poles of first and second magnets 230, 240 can be any suitable orientation in alternative exemplary embodiments.

Like stator 212, mover 222 also extends between a first end portion 223 and a second end portion 225. Thus, first and second end portions 223, 225 of mover 222 are spaced apart from each other, e.g., along the lateral direction L. Third magnet 250 is mounted to mover 222 at first end portion 223 of mover 222, and fourth magnet 260 is mounted to mover 222 at second end portion 225 of mover 222. Thus, third and fourth magnets 250, 260 are spaced apart from each other, e.g., along the lateral direction L.

Mover 222 can be constructed of any suitable material. In certain exemplary embodiments, mover 222 is constructed of a material having a relatively high conductivity. As an example, mover 222 may be constructed of a metal, such as steel.

As discussed above, third magnet 250 is positioned at first end portion 223 of mover 222. Third magnet 250 has an outer surface 252. Fourth magnet 260 is positioned at second end portion 225 of mover 222. Fourth magnet 260 also has an outer surface 262. Outer surface 252 of third magnet 250 and outer surface 262 of fourth magnet 260 may be positioned coplanar and/or parallel with each other.

Poles of third and fourth magnets 250, 260 may be oriented to assist with shaping the holding force of latch assembly 200. For example, a northern pole of third magnet 250 may be positioned at or adjacent outer surface 252 of third magnet 250, and a southern pole of third magnet 250 may be positioned at an opposite side of third magnet 250, e.g., adjacent or at first end portion 223 of mover 222. Conversely, a southern pole of fourth magnet 260 may be positioned at or adjacent outer surface 262 of fourth magnet 260, and a northern pole of fourth magnet 260 may be positioned at an opposite side of fourth magnet 260, e.g., adjacent or at second end portion 225 of mover 222. Such alignment can assist with coupling third and fourth magnets 250, 260 when latch assembly 200 is closed as will be understood by those skilled in the art. In particular, the orientation of the poles of first, second, third and fourth magnets 230, 240, 250, 260 can be complementary in order to increase a magnitude of the attractive force between such magnets. It should be understood that the orientation of the poles of third and fourth magnets 250, 260 can be any suitable orientation in alternative exemplary embodiments.

As discussed above, the position and orientation of first, second, third and fourth magnets 230, 240, 250, 260 relative to each other can assist with shaping the force required to shift latch assembly 200 from the closed position (shown in FIGS. 4 and 5) to the open position (shown in FIGS. 8 and 9). As may be seen in FIGS. 4 and 5, outer surface 252 of third magnet 250 is positioned at or adjacent outer surface 232 of first magnet 230 when latch assembly 200 is in the closed position, e.g., such that outer surface 232 of first magnet 230 is substantially parallel to outer surface 252 of third magnet 250. In particular, outer surface 252 of third magnet 250 overlaps outer surface 232 of first magnet 230 when latch assembly 200 is in the closed position. For example, when latch assembly 200 is in the closed position, only a portion of outer surface 252 of third magnet 250 faces or contacts outer surface 232 of first magnet 230.

As may be seen in FIGS. 4 and 5, outer surface 262 of fourth magnet 260 is also positioned at or adjacent outer surface 242 of second magnet 240, e.g., such that outer surface 242 of second magnet 240 is substantially parallel to outer surface 262 of fourth magnet 260, when latch assembly 200 is in the closed position. In particular, outer surface 262 of fourth magnet 260 overlaps outer surface 242 of second magnet 240 when latch assembly 200 is in the closed position. For example, when latch assembly 200 is in the closed position, only a portion of outer surface 262 of fourth magnet 260 faces or contacts outer surface 242 of second magnet 240.

In certain exemplary embodiments, a surface area of outer surface 232 of first magnet 230 and a surface area of outer surface 242 of second magnet 240 are about equal (e.g., within ten percent of), and a surface area of outer surface 252 of third magnet 250 and a surface area of outer surface 262 of fourth magnet 260 are also about equal (e.g., within ten percent of). In particular, the surface area of outer surface 232 of first magnet 230, the surface area of outer surface 242 of second magnet 240, the surface area of outer surface 252 of third magnet 250 and the surface area of outer surface 262 of fourth magnet 260 may be about equal.

Figure 10:
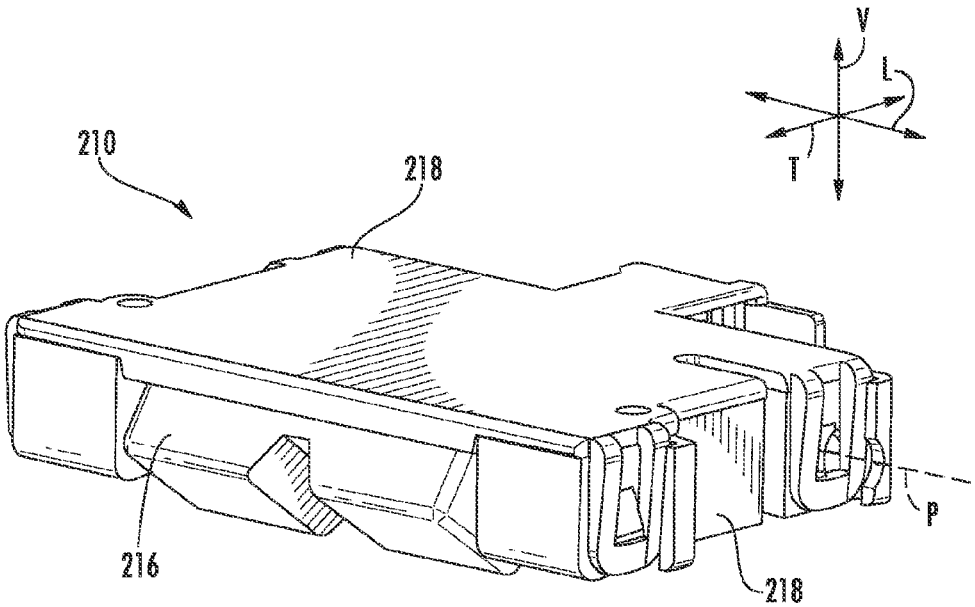
FIGS. 10 and 12 provide perspective views of a static portion of the exemplary latch assembly of FIG. 3 with a stator of the static portion shown in various positions.
Figure 11:
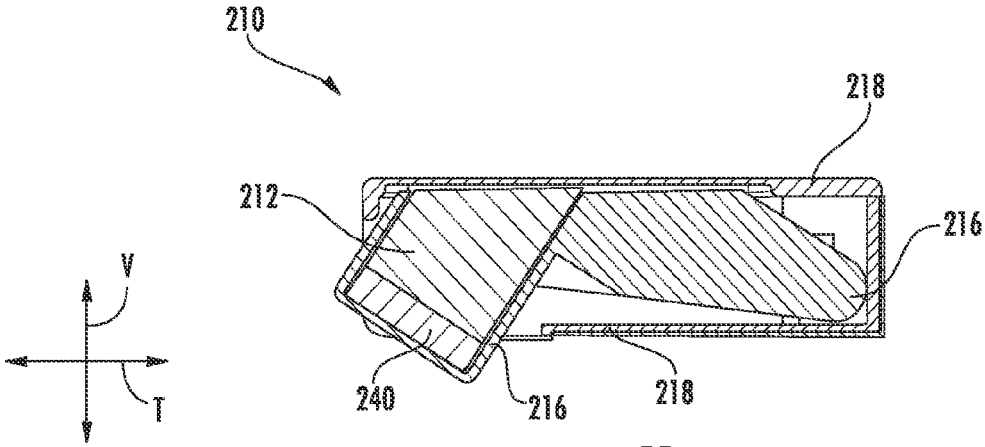
FIGS. 11 and 13 provide side, section views of the static portion of the exemplary latch assembly of FIG. 3 with the stator of the static portion shown in various positions.
Figure 12:
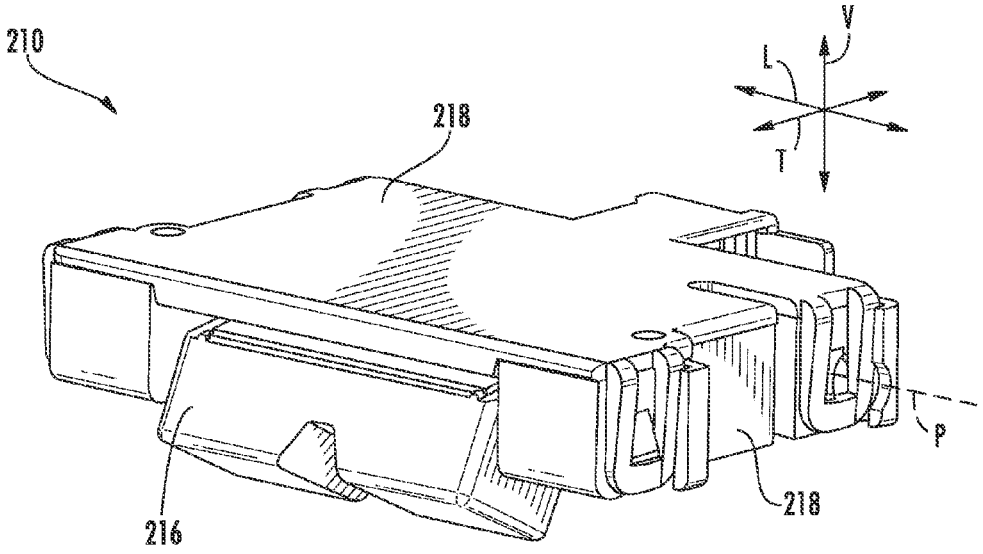
Figure 13:
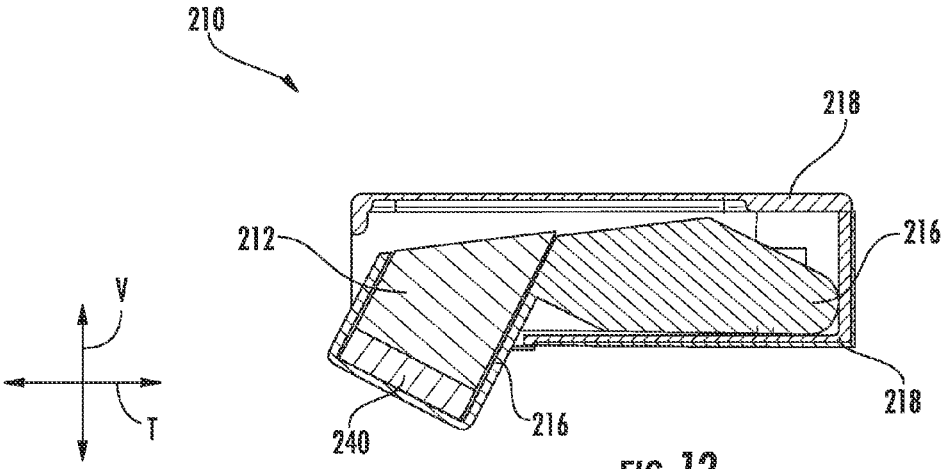

FIGS. 10 and 12 provide perspective views of static portion 210 of latch assembly 200 with stator 212 of static portion 210 shown in various positions. FIGS. 11 and 13 provide side, section views of static portion 210 of latch assembly 200 with stator 212 of static portion 210 shown in various positions. As may be seen in FIGS. 11 and 13, static portion 210 of assembly 200 includes a stator holder 216 and a housing 218. Stator 212 is positioned within and mounted to stator holder 216. First and second magnets 230, 240 on stator 212 may be positioned within stator holder 216, e.g., such that stator holder 216 is positioned between first magnet 230 and third magnet 250 and stator holder 216 is also positioned between second magnet 240 and fourth magnet 260. Thus, stator holder 216 may protect and/or encase first and second magnets 230, 240.

Stator holder 216 is positioned within housing 218. In particular, stator holder 216 is pivotally mounted to housing 218 such that stator holder 216 is pivotable on a pivot axis P relative to housing 218. The pivot axis P may be parallel to the lateral direction L, as shown in FIGS. 10 and 12.

In FIGS. 10 and 11, stator holder 216 is shown at a first position within housing 218. Conversely, stator holder 216 is shown at a second position within housing 218 in FIGS. 12 and 13. As may be seen in FIGS. 10-13, stator holder 216 may shift or adjust between the first and second positions by pivoting or rotating on pivot axis P. Stator 212 may move along the vertical direction V when stator holder 216 shifts or adjusts between the first and second positions. In particular, as shown in FIGS. 11 and 13, stator 212 may be positioned higher along the vertical direction V when stator holder 216 is in the first position than when stator holder 216 is in the second position. Thus, a, e.g., vertical, position of stator 212 may be adjusted or changed by pivoting stator holder 216 within housing 218.

Pivoting of stator holder 216 relative to housing 218 may assist with holding door 120 of dishwasher appliance 100 (FIG. 2) in the closed position. In particular, housing 218 may be fixed or mounted to tub 104 of dishwasher appliance 100 such that housing 218 is static relative to tub 104. When mounting door 120 to tub 104, a vertical position of door 120 on tub 104 may vary, e.g., by about two or three centimeters. Pivoting of stator holder 216 relative to housing 218 may assist with allowing stator 212 (e.g., and first and second magnets 230, 240) to engage mover 222 (e.g., and third and fourth magnets 250, 260) despite such vertical variability. For example, if door 120 is positioned high on tub 104, stator holder 216 may pivot to the first position (FIGS. 10 and 11) within housing 218 in order to permit stator 212 to engage mover 222. As another example, if door 120 is positioned low on tub 104, stator holder 216 may pivot to the second position (FIGS. 12 and 13) within housing 218 in order to permit stator 212 to engage mover 222.

Figure 18:
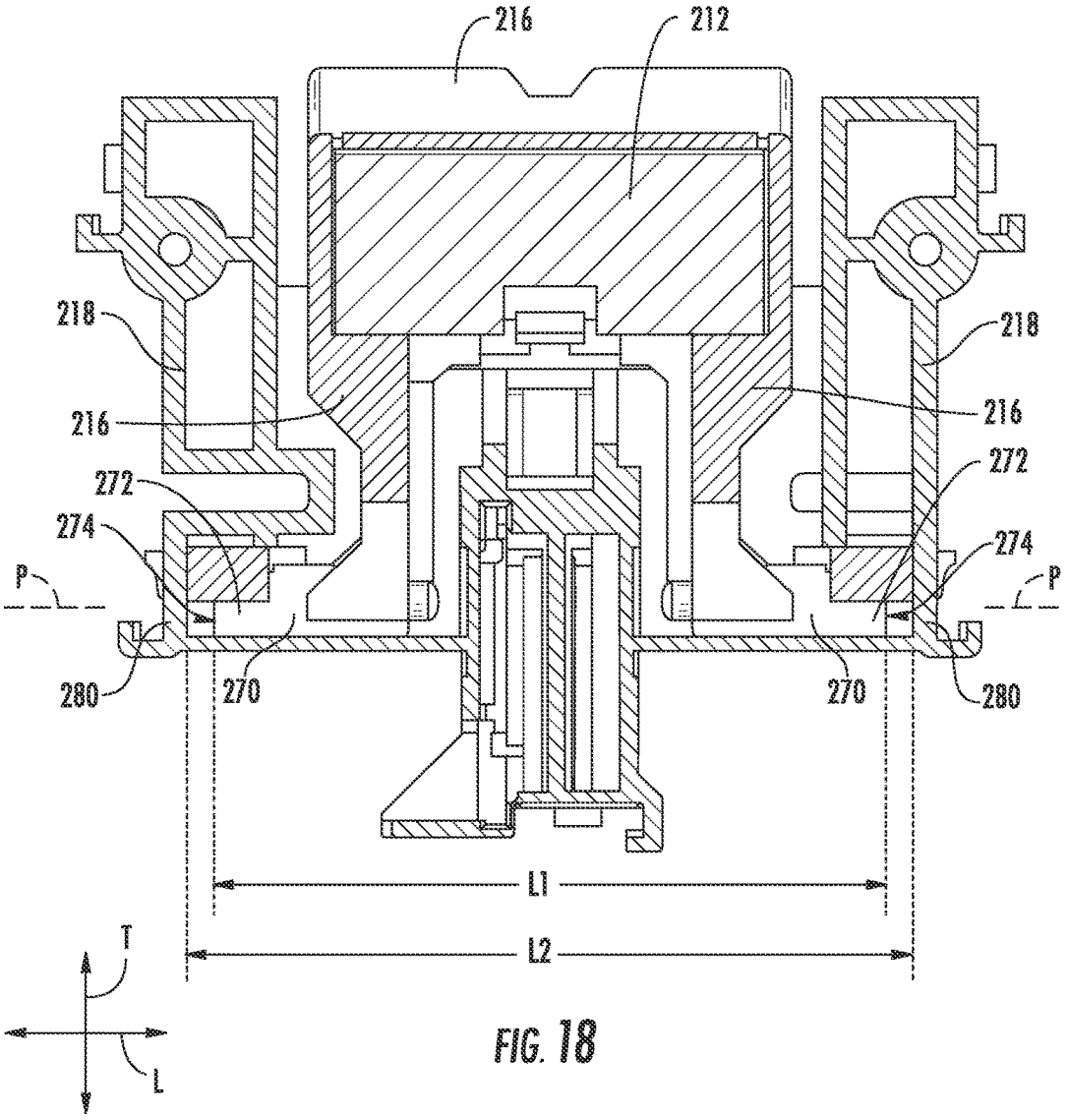
FIG. 18 provides a bottom, section view of the static portion of the exemplary latch assembly of FIG. 3.

FIG. 18 provides a bottom, section view of static portion 210 of latch assembly 200. Stator holder 216 may be pivotally mounted to housing 218 using any suitable mechanism or method. As an example, as shown in FIG. 18, stator holder 216 may include a pair of shafts 270. Shafts 270 may be positioned on the pivot axis P. In addition, shafts 270 may be positioned at opposite sides of stator holder 216. Thus, shafts 270 may be spaced apart from each other, e.g., along the lateral direction L. Shafts 270 are received by housing 218 in order to pivotally mount stator holder 216 to housing 218. In particular, each shaft of shafts 270 includes a cylindrical portion 272 that engages housing 218 in order to mount stator holder 216 to housing 218 such that stator holder 216 is pivotable on the pivot axis P.

Stator holder 216 can be constructed of any suitable material. In certain exemplary embodiments, stator holder 216 is constructed of a material having a relatively low conductivity. As an example, stator holder 216 may be constructed of a plastic. Housing 218 can also be constructed of any suitable material. In certain exemplary embodiments, housing 218 is constructed of a material having a relatively low conductivity. As an example, housing 218 may be constructed of a plastic.

Figure 14:
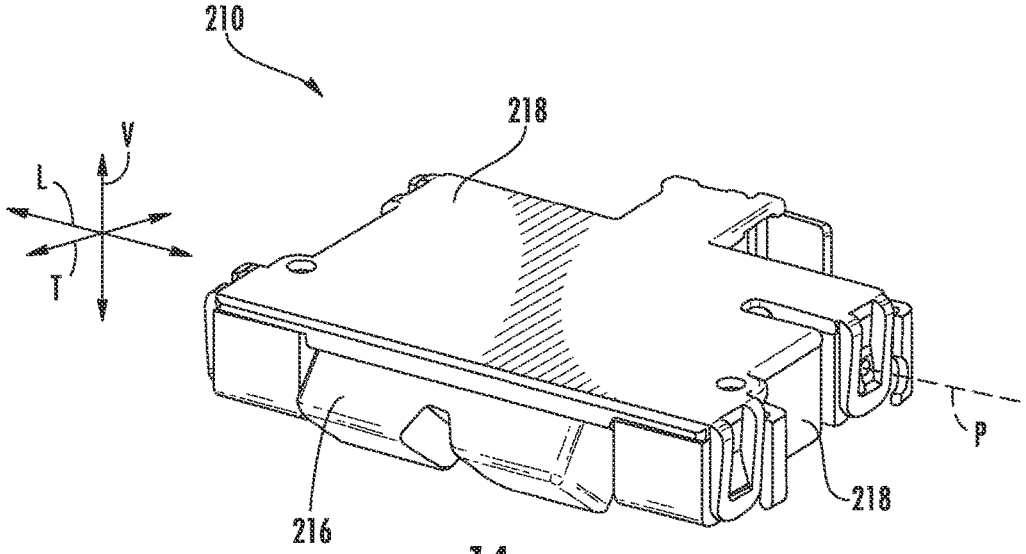
FIGS. 14 and 16 provide perspective view of the static portion of the exemplary latch assembly of FIG. 3 with the stator of the static portion shown in various locations.
Figure 15:
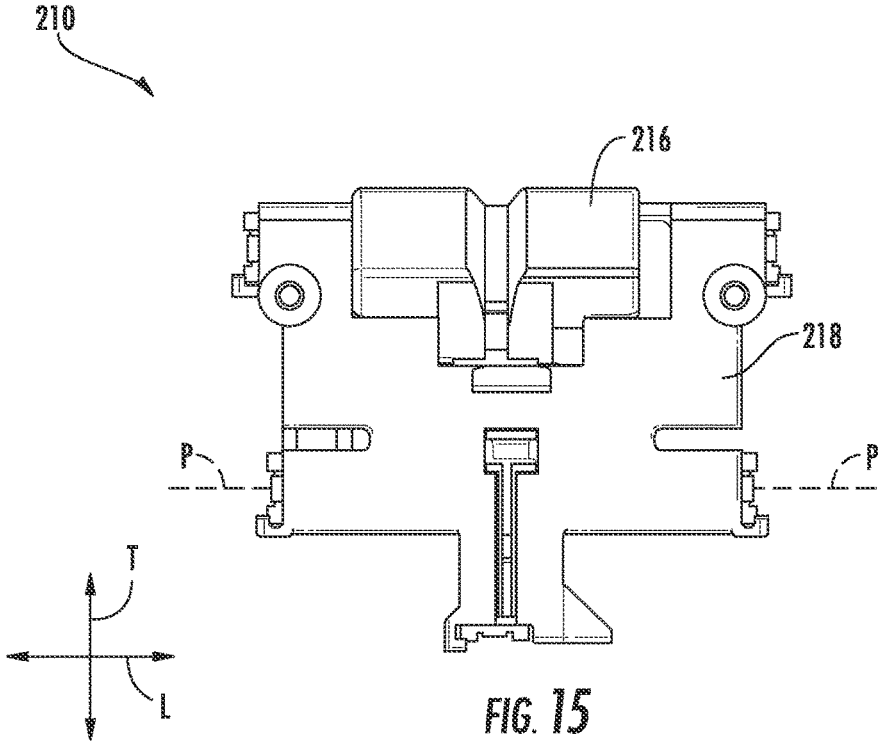
FIGS. 15 and 17 provide bottom, plan views of the static portion of the exemplary latch assembly of FIG. 3 with the stator of the static portion shown in various locations.
Figure 16:
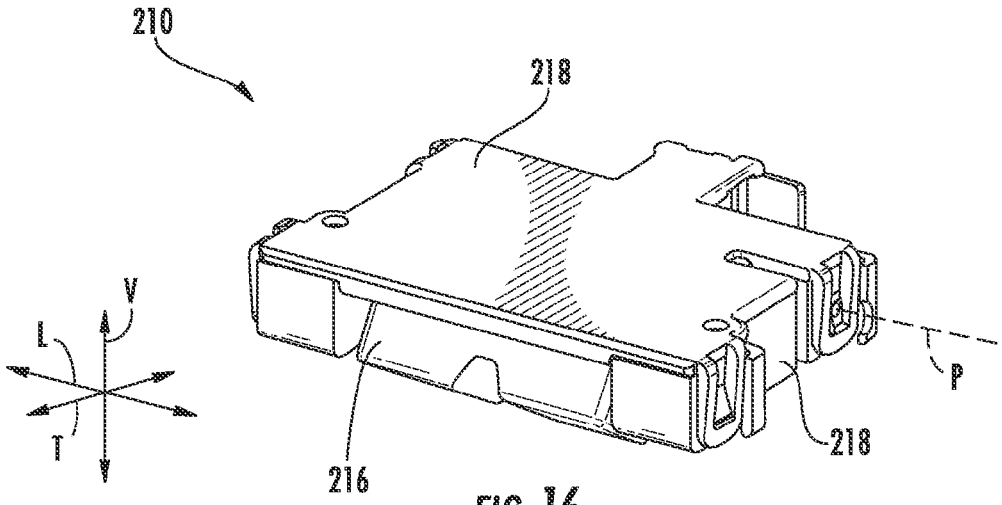
Figure 17:
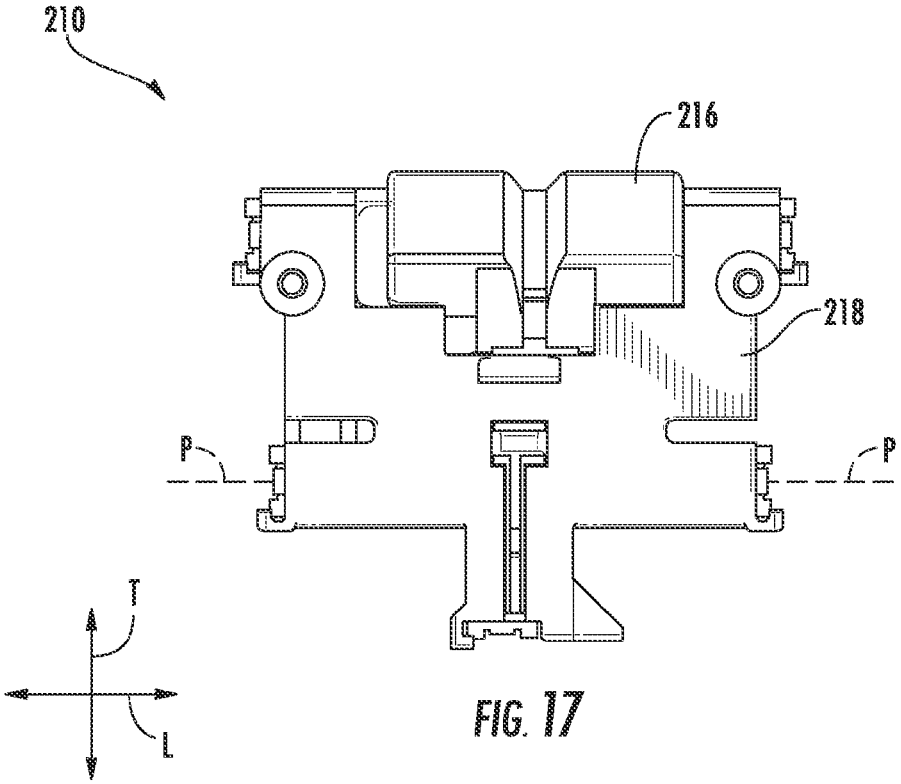

FIGS. 14 and 16 provide perspective view of static portion 210 of latch assembly 200 with stator 212 of static portion 210 shown in various locations. FIGS. 15 and 17 provide bottom, plan views of static portion 210 of latch assembly 200 with stator 212 of static portion 210 shown in various locations. As discussed above, stator 212 is positioned within and mounted to a stator holder 216, and stator holder 216 is positioned within housing 218, e.g., such that stator holder 216 is pivotable on the pivot axis P relative to housing 218. In addition, stator holder 216 is also movable within housing 218 along a direction that is parallel to the pivot axis P, e.g., along the lateral direction L.

In FIGS. 14 and 15, stator holder 216 is shown at a first location within housing 218. Conversely, stator holder 216 is shown at a second location within housing 218 in FIGS. 16 and 17. As may be seen in FIGS. 14-17, stator holder 216 may shift or adjust between the first and second locations by moving or sliding along the lateral direction L. Stator 212 also moves along the lateral direction L when stator holder 216 shifts or adjusts between the first and second locations.

Movement of stator holder 216 relative to housing 218 may assist with holding door 120 of dishwasher appliance 100 (FIG. 2) in the closed position. In particular, housing 218 may be fixed or mounted to tub 104 of dishwasher appliance 100 such that housing 218 is static relative to tub 104. When mounting door 120 to tub 104, a lateral location of door 120 on tub 104 may vary, e.g., by about two or three centimeters. Movement of stator holder 216 along the lateral direction L relative to housing 218 may assist with allowing stator 212 (e.g., and first and second magnets 230, 240) to engage mover 222 (e.g., and third and fourth magnets 250, 260) despite such lateral variability. For example, if door 120 is skewed to the left on tub 104, stator holder 216 may move to the first location (FIGS. 14 and 15) within housing 218 in order to permit stator 212 to engage mover 222. As another example, if door 120 is skewed to the right on tub 104, stator holder 216 may move to the second location (FIGS. 16 and 17) within housing 218 in order to permit stator 212 to engage mover 222.

Stator holder 216 may be movably mounted within housing 218 using any suitable mechanism or method. As an example, as shown in FIG. 18, distal end portions 274 of shafts 270 may be spaced apart from each other by a first length L1, e.g., along the lateral direction L. Conversely, housing 218 has side walls 280, and side walls 280 are spaced apart from each other by a second length L2, e.g., along the lateral direction L. Stator holder 216 may be positioned between side walls 280 of housing 218 such that stator holder 216 is movable along the lateral direction L between side walls 280 of housing 218. Thus, the second length L2 may be greater than the first length L1, e.g., in order to permit stator holder 216 to move between side walls 280 of housing 218. The first and second lengths L1, L2 may be any suitable lengths. For example, the second length L2 may be at least a quarter of an inch greater than the first length L1, e.g., such that stator holder 216 is movable by at least a quarter of an inch between side walls 280 of housing 218 along the lateral direction L.

Turning back to FIG. 3, mover 222 (FIG. 4) is mounted to a carrier or mover holder 226. Third and fourth magnets 250, 260 on mover 212 may be positioned within mover holder 226, e.g., such that mover holder 226 is positioned between first magnet 230 and third magnet 250 and mover holder 226 is also positioned between second magnet 240 and fourth magnet 260. Thus, mover holder 226 may protect and/or encase third and fourth magnets 250, 260. Mover holder 226 may be positioned on and contact stator holder 216 when latch assembly 200 is in the closed position.

Mover holder 226 can be constructed of any suitable material. In certain exemplary embodiments, mover holder 226 is constructed of a material having a relatively low conductivity. As an example, mover holder 226 may be constructed of a plastic. Mover holder 226 defines or includes a projection 290. As may be seen in FIG. 3 stator holder 216 defines a slot 292. Projection 290 of mover holder 226 is received within slot 292 of stator holder 216 when latch assembly 200 is in the closed position. Projection 290 and slot 292 may assist with aligning stator 212 and mover 222 as latch assembly 200 approaches the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A latch assembly, comprising:

a housing;

a holder pivotally mounted within the housing such that the holder is pivotable on a pivot axis relative to the housing, the holder defining a slot;

a stator having a first end portion and a second end portion, the stator being mounted to the holder;

a first magnet positioned at the first end portion of the stator, the first magnet having an outer surface;

a second magnet positioned at the second end portion of the stator, the second magnet having an outer surface, the outer surface of the second magnet positioned coplanar with the outer surface of the first magnet;

a carrier having a projection;

a mover mounted to the carrier and having a first end portion and a second end portion;

a third magnet positioned at the first end portion of the mover, the third magnet having an outer surface, the outer surface of the third magnet positioned adjacent the outer surface of the first magnet when the latch assembly is in a closed position; and a fourth magnet positioned at the second end portion of the mover, the fourth magnet having an outer surface, the outer surface of the fourth magnet positioned adjacent the outer surface of the second magnet when the latch assembly is in the closed position, the outer surface of the fourth magnet positioned coplanar with the outer surface of the third magnet, wherein the holder includes two distal end portions spaced apart from each other by a first length along the pivot axis, wherein the housing includes opposing side walls that are spaced apart from each other by a second length along the pivot axis, wherein the second length is greater than the first length, and wherein the holder linearly slides along the pivot axis between the opposing side walls of the housing in order to adjust to a lateral location of the carrier, wherein the slot of the holder is positioned on the holder between the first magnet and the second magnet, the projection of the carrier received within the slot of the holder when the latch assembly is in the closed position.

2. The latch assembly of claim 1, wherein the holder comprises a pair of shafts positioned at opposite sides of the holder on the pivot axis, the shafts of the pair of shafts received by the housing in order to pivotally mount the holder to the housing.

3. The latch assembly of claim 2, wherein each shaft of the pair of shafts includes a cylindrical portion that engages the housing.

4. The latch assembly of claim 2, wherein ends of the shafts of the pair of shafts correspond to the distal end portions of the holder and are spaced apart by the first length such that the holder is movable between the side walls of the housing.

5. The latch assembly of claim 1, wherein the second length is at least a quarter of an inch greater than the first length such that the holder is movable by at least a quarter of an inch between the side walls of the housing.

6. The latch assembly of claim 1, wherein the outer surface of the third magnet overlaps the outer surface of the first magnet when the latch assembly is in the closed position, the outer surface of the fourth magnet overlapping the outer surface of the second magnet when the latch assembly is in the closed position.

7. The latch assembly of claim 1, wherein stator and the mover are constructed with ferromagnetic material.

8. The latch assembly of claim 1, wherein the first magnet and the second magnet fixed to the stator and the third magnet and the fourth magnet are fixed to the mover.

9. An appliance, comprising:

a cabinet;

a door pivotally mounted to the cabinet; and a latch assembly configured for selectively securing the door in a closed configuration, the latch assembly comprising a housing fixed relative to the cabinet;

a holder pivotally mounted within the housing such that the holder is pivotable on a pivot axis relative to the housing;

a stator having a first end portion and a second end portion, the stator being mounted to the holder;

a first magnet positioned at the first end portion of the stator, the first magnet having an outer surface;

a second magnet positioned at the second end portion of the stator, the second magnet having an outer surface, the outer surface of the second magnet positioned parallel to the outer surface of the first magnet;

a mover having a first end portion and a second end portion, the mover positioned on the door such that the mover is fixed relative to the door;

a third magnet positioned at the first end portion of the mover, the third magnet having an outer surface, the outer surface of the third magnet positioned at the outer surface of the first magnet when the door is in the closed configuration; and a fourth magnet positioned at the second end portion of the mover, the fourth magnet having an outer surface, the outer surface of the fourth magnet positioned at the outer surface of the second magnet when the door is in the closed configuration, the outer surface of the fourth magnet positioned parallel to the outer surface of the third magnet, wherein the holder includes two distal end portions spaced apart from each other by a first length along the pivot axis, wherein the housing includes opposing side walls that are spaced apart from each other by a second length along the pivot axis, wherein the second length is greater than the first length, and wherein the holder linearly slides along the pivot axis between opposing side walls of the housing in order to adjust to a lateral location of the door.

10. The appliance of claim 9, wherein the holder comprises a pair of shafts positioned at opposite sides of the holder on the pivot axis, the shafts of the pair of shafts received by the housing in order to pivotally mount the holder to the housing.

11. The appliance of claim 10, wherein each shaft of the pair of shafts includes a cylindrical portion that engages the housing.

12. The appliance of claim 10, wherein ends of the shafts of the pair of shafts correspond to the distal end portions of the holder and are spaced apart by the first length such that the holder is movable between the side walls of the housing.

13. The appliance of claim 9, wherein the second length is at least a quarter of an inch greater than the first length such that the holder is movable by at least a quarter of an inch between the side walls of the housing.

14. The appliance of claim 9, further comprising a carrier mounted to the door, the mover mounted to the carrier, the carrier defining a projection, the holder defining a slot, the projection of the carrier received within the slot of the holder when the door is in the closed configuration.

15. The appliance of claim 9, wherein the outer surface of the third magnet overlaps the outer surface of the first magnet when the door is in the closed configuration, the outer surface of the fourth magnet overlapping the outer surface of the second magnet when the door is in the closed configuration.

16. The appliance of claim 9, wherein the first magnet and the second magnet are fixed to the stator and the third magnet and the fourth magnet are fixed to the mover.

* * * * *